United States Patent [19]

Paterson et al.

[11] Patent Number: 4,478,372

[45] Date of Patent: Oct. 23, 1984

[54] BYPASS FEED APPARATUS

[75] Inventors: Malcolm M. Paterson, Lee, N.H.; Dennis H. Plowell, Lowell, Mass.

[73] Assignee: Raytheon Company, Lexington, Mass.

[21] Appl. No.: 20,556

[22] Filed: Mar. 15, 1979

[51] Int. Cl.³ ..... B02C 25/00

[52] U.S. Cl. ..... 241/35; 241/135; 414/272

[58] Field of Search ..... 241/34, 35, 135, 136, 241/138, 186.2, 186.3, 40; 414/270, 272, 273, 275, 269; 198/358

[56] References Cited

U.S. PATENT DOCUMENTS

| | | | |
|---|---|---|---|
| 2,652,984 | 9/1953 | Dodds | 241/135 |
| 3,648,820 | 3/1972 | Schafer et al. | 198/358 |
| 3,734,414 | 5/1973 | Weigel et al. | 241/40 |
| 4,082,228 | 4/1978 | Paterson et al. | 241/135 X |
| 4,140,213 | 2/1979 | Denison | 198/358 |
| 4,161,094 | 7/1979 | Blidung et al. | 198/358 X |

FOREIGN PATENT DOCUMENTS

| | | | |
|---|---|---|---|
| 2754859 | 8/1978 | Fed. Rep. of Germany | 198/358 |

*Primary Examiner*—Mark Rosenbaum

*Attorney, Agent, or Firm*—John T. Meaney; Joseph D. Pannone; R. M. Sharkansky

[57] ABSTRACT

A materials handling or processing system which includes at least two processing devices such as shredders, for example, which are subject to unexpected and relatively sudden discontinuance of operation as by clogging or other breakdown condition, and transporting apparatus for conveying materials being processed to the processing devices, the invention comprising means for detecting such breakdown in one of the devices and for consequently directing to the second device the flow of materials normally directed to the broken down device, thereby maintaining continued processing of materials without interrupting their flow through the system.

22 Claims, 6 Drawing Figures

BYPASS FEED APPARATUS

BACKGROUND OF THE INVENTION

Material handling or processing systems have been commonly employed for receiving a continuous flow of materials of various types, sizes, and consistencies and for performing various processing techniques upon these materials as they are transported from one station to another. For example, municipal waste handling systems are adapted to receive a continuously flowing supply of commingled waste materials, transport the materials to a device such as a shredder where the materials are reduced to a maximum preselected size, and then transport the shredded materials to a collection area for storage or subsequent processing such as classification, incineration, or the like.

It is well known that municipal waste, for example, contains a wide variety of miscellaneous components such as garbage, paper, aluminum, steel and tin cans, plastic items, textiles, and large metal items such as castings, for example. It is necessary that large items be considerably reduced in size where the commingled materials are to be further processed, such as where subsequent classification is to be performed. For such size reduction it is required that the received commingled materials be moved through a suitable shredder which employs a system of knives, hammers, or grinding elements to reduce the overall size of the materials to a selected maximum, such as twelve inches, one inch, or other selected dimension.

Shredders of conventional construction, however, as a result of such heavy duty use are often subject to unexpected or relatively sudden discontinuance of operation or breakdown such as might be caused, for example, by jamming or clogging, or by damage to the size-reducing knife or hammer elements, or for other reasons. In such cases it has been necessary to shut down the operation of the entire system or of a substantial portion thereof, while the damage to the shredder is being repaired or while any other reason for the breakdown is being rectified. Obviously, such shutting down of a system of this character is highly undesirable for many reasons. For example, a system of this type is designed to process a selected relatively large number of tons of material during each hour of operation. Shutting down is consequently expensive in not only loss of processed materials value, but also in undesired reduction in operating manpower.

SUMMARY OF THE INVENTION

The foregoing and other objections to and disadvantages of known material handling or processing systems are overcome in the present invention which includes a shredder or other processing device, conveyor means for transporting mixed materials to the device, and means connected to the device and operable upon detection of breakdown of the device to automatically divert the materials away from the device and to a second such device without interrupting the flow of the materials through the system.

More specifically, conveyor systems are provided for individually supplying materials to one, two or more processing devices such as shredders, for example. Should one device become inoperative, a portion of the conveyor system feeding that device will automatically relocate so as to feed the materials to a second device. Thus, flow of materials will continue without interruption. Preferably, the movable portion of conveyor, which normally is located so that its discharge end is positioned to drop materials into the first device, will be extended so that materials from its discharge end will be fed to the second device.

In another embodiment of the invention, means is also provided for automatic operation in the event the second device breaks down to divert to the first device the materials which would otherwise flow into the broken down second device. More specifically, an adjustable conveyor is positioned to normally feed materials into the second device. However, when the second device is inoperable, the position of the conveyor is automatically adjusted so as to direct flow of materials to the first device.

Accordingly, breakdown of one device in a pair thereof will not cause an interruption in the flow of materials being processed.

BRIEF DESCRIPTION OF THE DRAWINGS

The above and other advantages of this invention will become apparent from the following description taken in connection with the accompanying drawings, wherein.

DESCRIPTION OF THE PREFERRED EMBODIMENTS

Figure 1:
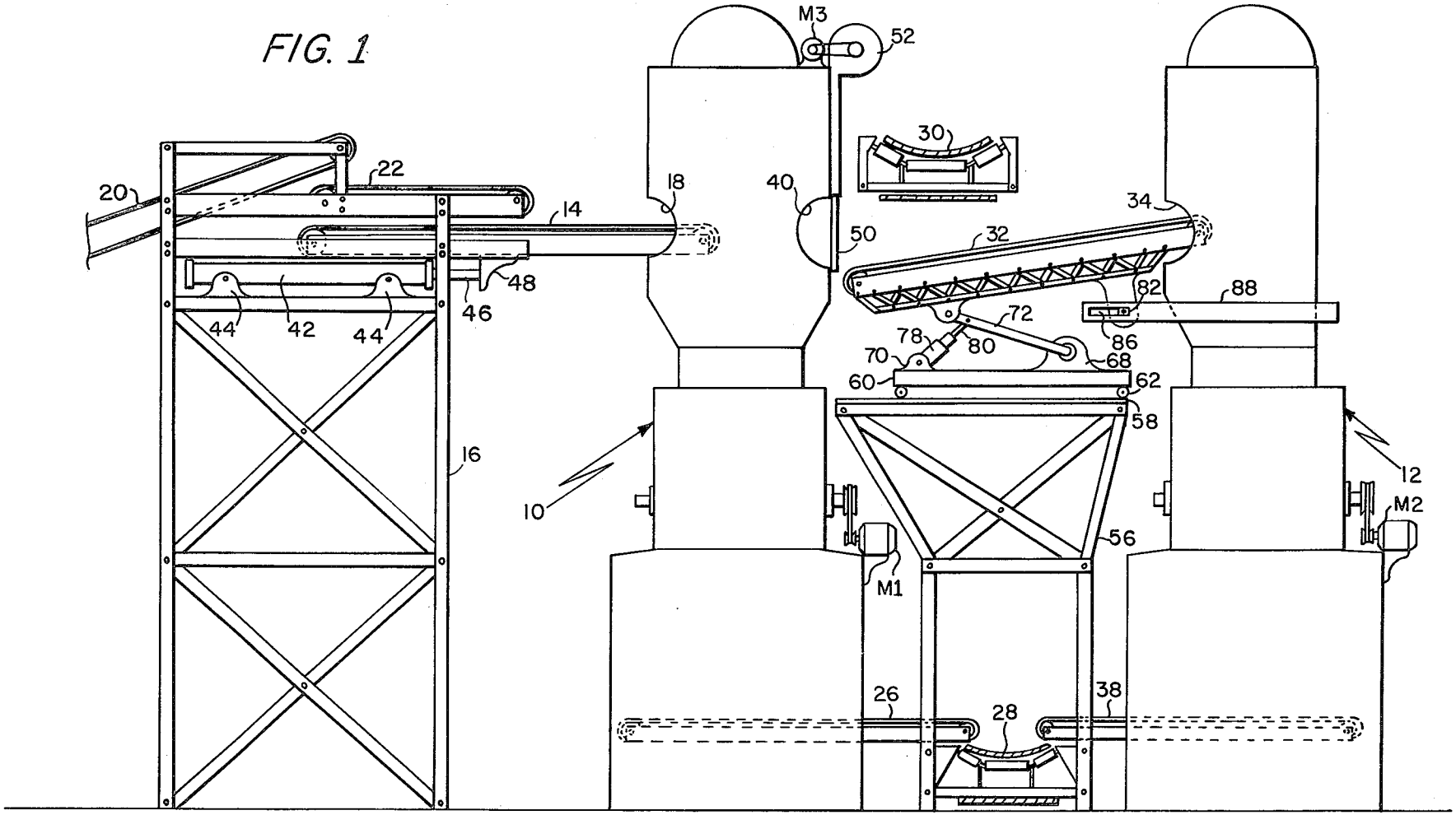
FIG. 1 is an elevational view of a materials handling system embodying the invention.

Referring more particularly to the drawings, wherein like characters of reference designate like parts throughout the several views, a portion of a complete materials handling system is shown in FIG. 1. The system may be a resource recovery system or any other system which involves the movement of a single material or commingled materials from a first position to one or more pieces of apparatus which are employed to perform selected operations on the material or materials, such as shredding or the like. The present invention is particularly designed for use in systems employing two or more shredders.

In resource recovery systems which are used to process municipal waste, for example, the waste normally comprises commingled materials of various sizes, shapes and consistencies such as garbage, paper, plastics, metal cans, bottles, and cast iron or steel objects. In cases where the materials are to be air classified, the waste is preferably preshredded to a size of less than one cubic foot, for example, and may be shredded to even smaller sizes such as not larger than about one cubic inch, for example, if desired.

This makes it much easier for light objects such as paper, thin plastics, light pieces of cloth, leaves and the like to become air-borne during subsequent air classification procedures.

Conventional shredders have within them the usual size-reducing elements such as hammers, flails, blades or knives which engage the material introduced into the top of the shredder and reduce them to the required maximum size.

Referring to FIG. 1, the materials handling system is shown as including two shredders 10 and 12 or other processing devices which may at times become inoperative by breakdown or for other reasons. In conventional systems it is usually necessary to shut down the entire system when a device is being repaired. This sometimes causes lengthy shutdowns with consequent reduction in output of the system and in inefficient utilization of manpower.

In accordance with the present invention there is provided means for detecting breakdown of a shredder and means operating in response to such detection of breakdown for diverting the flow of materials from the inoperative shredder to the other shredder. This will obviously overcome the problems caused by stoppage of a system which is designed to feed materials to the inoperative shredder, since such materials will be rerouted to the operative shredder without interruption in the feeding process.

As shown in FIG. 1, materials to be shredded are fed into shredder 10 by means of a feed conveyor 14 which is supported on a suitable frame 16 with its discharge end projecting a short distance into the upper portion of the shredder 10 through an opening 18 therein. Materials are directed to feed conveyor 14 by a supply conveyor 20. An intermediate conveyor 22, also supported by frame 16, is interposed between the feed conveyor 14 and the discharge end of the supply conveyor 20 so as to properly direct materials onto the feed conveyor 14 when the feed conveyor is in the position shown in FIG. 1 or in a different position as shown by dotted lines in FIGS. 2 and 3 and as will be described hereinafter.

Figure 2:
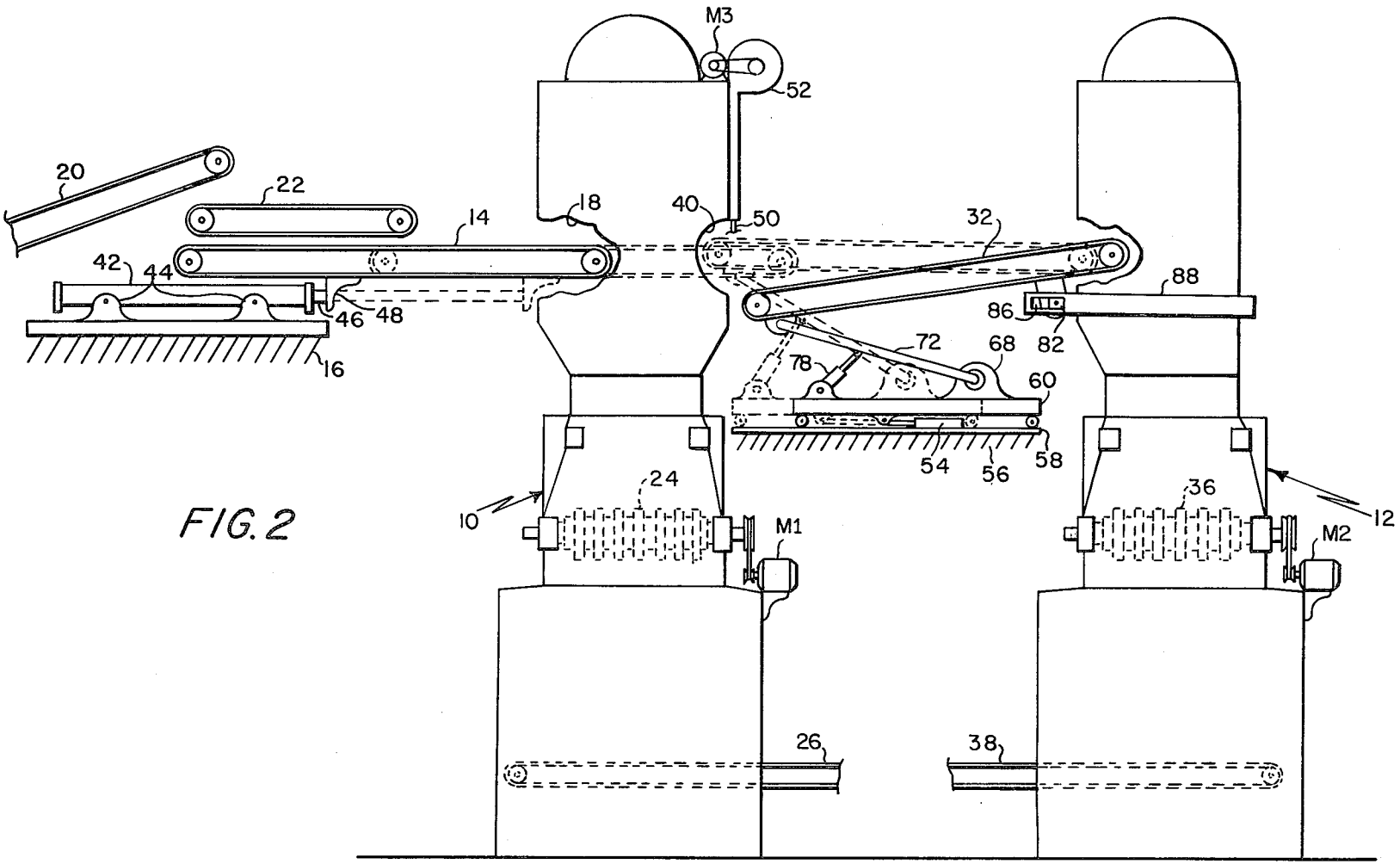
FIG. 2 is an elevational view of the materials handling system of FIG. 1 diagrammatically illustrating the operations of the mechanical by-pass devices.

In the normal operation of shredder 10, the materials deposited therein from the discharge end of the feed conveyor 14 will fall into the size-reducing elements which are indicated at 24 in FIG. 2 and which are revolved by a motor MI. After passing downwardly through elements 24, and consequently being reduced in size thereby, the shredded materials drop to the bottom of the shredder 10 onto a discharge conveyor 26 which carries them out of the shredder and deposits them onto a removal conveyor 28 for transport to another location for subsequent processing.

At the same time a second supply conveyor 30 deposits materials onto a second feed conveyor 32 which has its discharge end projecting into the upper portion of the second conveyor 12 through opening 34. Materials falling from the discharge end of the second feed conveyor 32 will drop into the size-reducing elements 36 therein (see FIG. 2) and will be shredded thereby, eventually dropping onto a second discharge conveyor 38 for removal from the shredder 12. Discharge conveyor 38 will function to deposit the shredded materials on removal conveyor 28 or on a separate conveyor which will transport the shredded materials to another location for subsequent processing. The shredding elements 36 are moved by a motor M2 similar to operation of shredder 10.

When either shredder 10 or 12 becomes jammed or otherwise imoperable, means is provided for detecting such condition and, in response thereto, for automatically diverting the feed of materials from the inoperable shredder to the other shredder.

Figure 3:
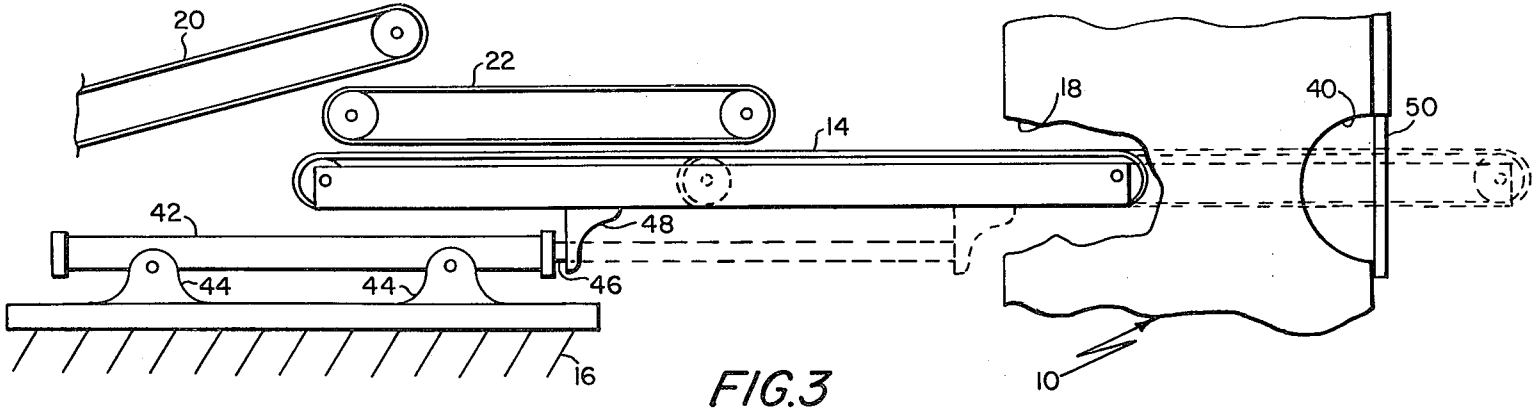
FIG. 3 is a fragmentary elevational view illustrating the adjustable conveyor by-pass mechanism associated with a first shredder.

First considering a breakdown of shredder 10, the feed conveyor 14 will be moved forward to the position shown by dotted lines in FIG. 3. A rear entrance opening 40 is provided in the upper end portion of shredder 10 opposite the front opening 18. When the feed conveyor 14 is moved, such movement is longitudinally and in a forward direction so that the discharge end of the conveyor 14 passes all the way through the shredder and emerges through rear opening 40 where it becomes positioned over the second feed conveyor 32. Thus, materials from the first feed conveyor 14 are fed onto the second feed conveyor 32 and eventually fed into the second shredder 12, bypassing the first shredder 10 and allowing the conveyors 20, 22 and 14 to continue operating.

The means for moving the feed conveyor 14 is preferably a hydraulic ram 42 which is fixed upon frame 16 as by brackets 44 and has its reciprocal plunger 46 attached to the conveyor 14 by one or more supporting members 48. Thus, actuation of the hydraulic ram 42 will propel the conveyor 14 to the position shown by dotted lines. Activation of the ram in the reverse direction will, of course, cause the feed conveyor 14 to return to its normal position.

The shredder 10 is provided with a shield 50 which normally is positioned in overlying relation to the rear opening 40. The shield 50, preferably of metal, is supported by and adapted to roll up within a suitable casing 52 upon activation of a motor M3. Such action will occur simultaneous with or just prior to activation of hydraulic ram 42 so that the opening will be cleared for movement of feed conveyor 14 through it. Obviously, the motor M3 may be operated to return the shield to its normal lowered position when the feed conveyor 14 is returned to its normal operating position.

Considering now a breakdown of shredder 12, the receiving end of second feed conveyor 32 is moved upwardly and in a direction toward the first shredder 10 so as to position that end of the conveyor within the rear opening 40 in shredder 10 (FIGS. 2 and 3). Simultaneously therewith the shield 50 on shredder 10 is raised and the direction of the belt on conveyor 32 is reversed. Thus, the end of the conveyor which projects through opening 40 has become the discharge end, and materials which continue to fall on conveyor 32 are now fed into the first shredder 10, bypassing the inoperable second shredder 12.

Figure 6:
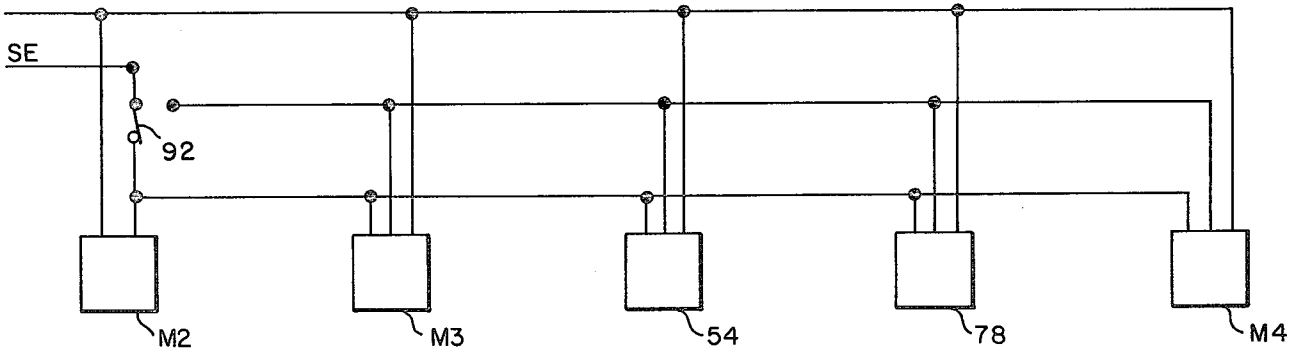
FIG. 6 is a schematic circuit for controlling response to inoperation of a second processing device.

The belt of conveyor 32 is operated in the usual manner by a motor as are the belts of the other conveyors. The motor for driving conveyor 32 is indicated in the diagram of FIG. 6 as motor M4.

Figure 4:
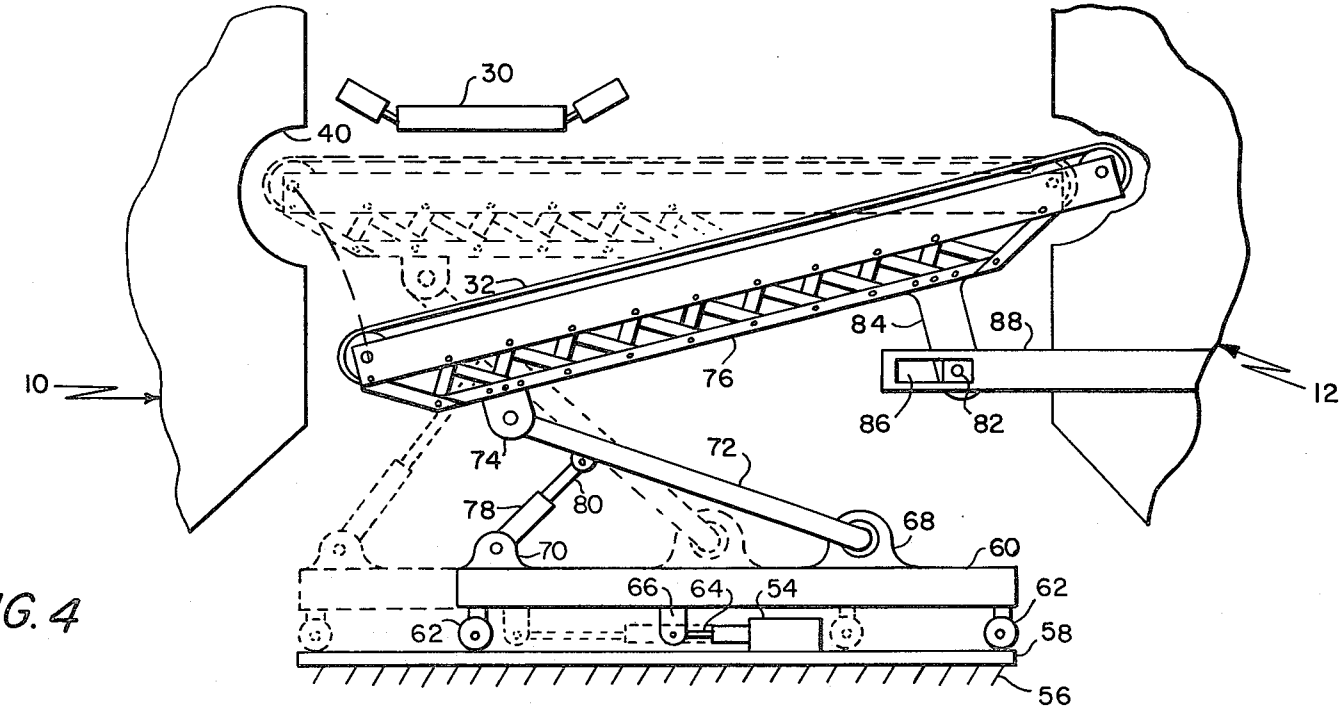
FIG. 4 is a fragmentary elevational view illustrating the adjustable conveyor by-pass mechanism associated with the second shredder.

The means for moving the second feed conveyor 32 to the bypass position is preferably a second hydraulic ram 54 (FIG. 4) which is supported upon a suitable frame 56. Frame 56 carries a metal track 58 upon which the ram 54 is fixed. Immediately above the ram and track is a carriage 60 which rides on the track 58 by means such as wheels or rollers 62 mounted on its under side adjacent the ends.

The reciprocal plunger 64 of the ram 54 is preferably telescopic and its attached at its end to the under side of carriage 60 by a bracket 66 whereby when the ram 54 is operated the plunger 64 will extend and in doing so will move the carriage 60 along track 58 toward shredder 10.

Upon the upper surface of carriage 60 are a pair of longitudinally spaced upstanding supports 68 and 70. The lower end of a conveyor support arm 72 is pivotally mounted in support 68 and extends upwardly and forwardly therefrom as shown best in FIG. 4. The upper forward end of arm 72 is pivotally attached to a bracket 74 carried by a conveyor support frame 76 upon which second feed conveyor 32 is mounted. When the carriage 60 moves in a direction toward the shredder 10, arm 72 will cause movement of the conveyor 32 in the same direction.

To provide upward movement of the conveyor 32, a telescopic hydraulic ram 78 is pivotally mounted on support 70 and has its plunger 80 pivotally attached to a midpoint of arm 72. Thus, when the carriage 60 is moved by ram 54, ram 78 will simultaneously operate to raise the arm 72 and consequently the conveyor 32. In this way the end of the conveyor 32 will be properly guided into the opening 40 in shredder 10. Such upward movement of the conveyor 32 will preferably be a pivotal action which occurs about a point such as, for example, the axis of a pivot 82 carried by an arm 84 depending from conveyor frame 76 and riding within a slot 86 in the adjacent end of a conveyor support member 88 which is suitably fixed upon shredder 12.

Figure 5:
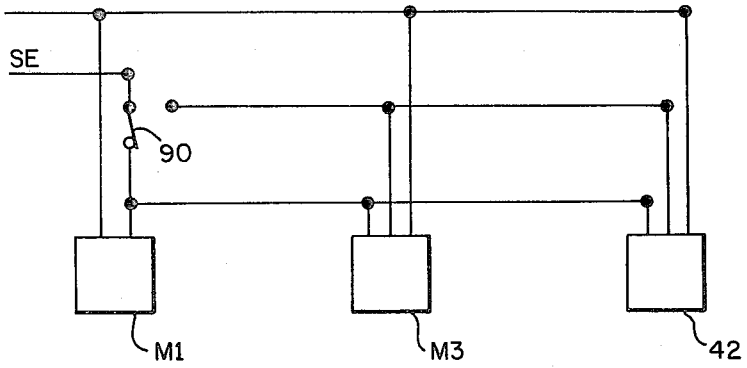
FIG. 5 is a schematic circuit for controlling response to inoperation of a first processing device.

In the operation of the described system, the shredder motor M1 may be employed as the element which performs detection of the breakdown of the first shredder 10. A heat overload switch 90 (FIG. 5) is connected between motor M1 and the source of energy SE. Motor M3 and ram 42 are also connected to the source of energy SE but are deactivated when the switch 90 is closed to energize motor M1. However, when the motor M1 becomes overloaded, the resultant heat thereof will be detected by switch 90 which will operate to open the circuit to motor M1 and to close the circuits to motor M3 and ram 42, and then to trip off. This will cause motor M3 to quickly raise shield 50 and thus open the rear opening in shredder 10, and simultaneously will cause ram 42 to move the feed conveyor 14 through the shredder 10 to a position where its discharge end overlies the feed conveyor 32 of shredder 12.

When shredder 10 is subsequently repaired or otherwise made operable, the switch 90 will be returned to a position which will again energize shredder motor M1 and which will also energize motor M3 and ram 42 to cause them to operate in a reverse direction for the necessary time to retract the feed conveyor 14 and drop the shield 50 to the positions shown in FIG. 1, and then shut off, whereupon the flow of materials from conveyor 14 to shredder 10 is continued.

The shredder motor M2 may be employed as the element which performs detection of the breakdown of shredder 12. Referring to FIG. 6, a heat overload switch 92 is connected between motor M2 and the source of energy SE. Shield motor M3, rams 54 and 78 and conveyor motor M4 are also connected to the source of energy SE but are deactivated when the switch 92 is closed to energize motor M1. However, when motor M1 becomes overloaded, the resultant heat thereof will be detected by switch 92 which will operate to open the circuit to motor M1 and to close the circuits to motor M3, rams 54 and 78 and motor M4 and then to trip off. This will cause motor M3 to quickly raise the shield 50 and thus open the rear opening in shredder 10. This will simultaneously cause rams 54 and 78 to raise and position the second feed conveyor 32 so that its discharge end projects through rear opening 40 into shredder 10. Also, substantially simultaneous therewith, motor M4 will reverse direction to cause the belt of conveyor 32 also to reverse.

When shredder 12 is subsequently repaired or otherwise made operable, the switch 92 will be returned to a position which will again energize shredder motor M2 and which will also energize motor M3 and rams 54 and 78 to cause them to operate in a reverse direction for the necessary time to retract the feed conveyor 32 and drop the shield 50 to the positions shown in FIG. 1, and then shut off; also, motor M4 will again be reversed to reverse the direction of the belt on conveyor 32, whereupon the flow of materials from conveyor 32 to shredder 12 is continued.

It will be apparent from the foregoing that all of the objectives of this invention have been achieved by the apparatus shown and described whereby a sudden inoperability of a processing device in a materials processing system will be detected and flow of materials will be allowed to proceed and processing continued without interruption in bypassing relation to the inoperable device.

It will also be apparent that modifications and changes in the invention shown and described may be made by those skilled in the art without departing from the spirit of the invention as expressed in the accompanying claims. Therefore, all matter shown and described is to be interpreted as illustrative and not in a limiting sense.

What is claimed is:

1. A material handling system comprising first and second processing devices, first feeder material transporting means for normally moving material thereon from a first source to said first device, second feeder material transporting means for normally moving material thereon from a second source to said second device, detection means for detecting when one of said devices is inoperative, and operative means operable in response to said detection means for automatically moving the first feeder material transporting means to a position where material thereon is moved to the second device when said first device is inoperative and for moving the second feeder material transporting means to a position where material thereon is moved to the first device when said second device is inoperative.

2. A system as set forth in claim 1 wherein said first and second feeder material transporting means are simultaneously operable.

3. A system as set forth in claim 1 wherein said devices are shredders and said transporting means are conveyors.

4. A material handling and processing system comprising first and second shredders, a first conveyor normally positioned to move material thereon from a first source to said first shredder, a second conveyor normally positioned to move material thereon from a second source to said second shredder, first and second detection means connected respectively to said first and second shredders for detecting inoperability thereof, first and second movable support means connected respectively to said first and second conveyors, said movable support means being operable in response to detection of inoperability of one of the shredders for moving the conveyor normally associated with said one of the shredders to a position where material thereon from said first source together with material on the other conveyor from said second source will be moved to the other shredder.

5. A material processing system comprising first and second shredders, a first conveyor normally disposed in a position to feed material thereon to said first shredder, a second conveyor normally disposed in a position to feed material thereon to said second shredder, detection means connected to said first and second shredders for detecting inoperativeness thereof, and operating means operable in response to said detection means for moving said first conveyor to another position where material thereon is fed to said second shredder when inoperativeness of said first shredder is detected and for moving said second conveyor to another position where material thereon is fed to said first shredder when operativeness of said second shredder is detected.

6. A system as set forth in claim 5 wherein said operating means includes a hydraulic ram having a movable plunger connected to said first conveyor.

7. A system as set forth in claim 5 where said first shredder has a first opening within which the discharge end of said first conveyor normally is positioned, said first shredder having a second opening opposite said first opening, and said first conveyor being longitudinally movable through said first shredder and second opening to locate said discharge end in a second position to move materials thereon to said second conveyor for feeding into said second shredder.

8. A system as set forth in claim 7 wherein a hydraulic ram supports said first conveyor and is operable to move the first conveyor to said second position in response to detection by said detection means of inoperability of said first shredder.

9. A system as set forth in claim 7 wherein a shield is normally positioned over said second opening, and means is provided for moving said shield from said second opening, said means being connected to said detection means for operation when said detection means detects inoperability of said first shredder.

10. A system as set forth in claim 7 wherein said first conveyor is located in a substantially horizontal plane and is movable longitudinally in said plane in response to said detection means.

11. A system as set forth in claim 7 wherein said shredders are simultaneously operable.

12. A material processing system comprising first and second shredders, a feed conveyor disposed to feed material thereon from a first source to said first shredder, conveyor means disposed in a first position and operated in a first direction for feeding material thereon from a second source to said second shredder, detection means connected to said second shredder for detecting inoperation thereof, and operating means operable in response to said detection means for moving said conveyor means from said first position to a second position and for operating said conveyor means in a second direction to feed material thereon to said first shredder.

13. A system as set forth in claim 12 wherein said operating means includes a hydraulic ram, and a movable carriage connected to said ram for movement thereby, said conveyor being adjustably supported on said carriage.

14. A system as set forth in claim 12 wherein said feed conveyor is disposed to feed material thereon to said first shredder through a first opening, said first shredder having a second opening opposite said first opening, and said conveyor means being movable to locate an end thereof in a second position and operable in said second direction for feeding materials thereon directly to said first shredder through said second opening.

15. A system as set forth in claim 14 wherein a carriage is disposed beneath said conveyor means for movement toward and away from said first shredder, a hydraulic ram is connected to said carriage for moving the carriage in response to said detection means, and said conveyor means is mounted on said carriage for movement therewith.

16. A system as set forth in claim 15 wherein said conveyor means is inclined upwardly toward said second shredder, a hydraulic lifter is mounted on said carriage and is connected to said conveyor means, said lifter being operable with said ram to raise said conveyor means to a position opposite said second opening while said ram is moving the conveyor means toward said first shredder.

17. A system as set forth in claim 14 wherein a shield is normally positioned over said second opening, and means is provided for moving said shield from said second opening, said means being connected to said detection means for operation when said detection means detects inoperability of said second shredder.

18. A system as set forth in claim 14 wherein said conveyor means and said feed conveyor are simultaneously operable.

19. A material processing system comprising a first shredder having an input opening and an opposing opening, a second shredder having an input opening, material conveyer means having a discharge end portion adapted to be disposed in the input opening of the first shredder and operable for feeding material to the first shredder, detection means connected to the first shredder for detecting malfunction thereof, and operating means operable in response to the detection means for moving said discharge end portion of the conveyer means through said opposing opening of the first shredder and into said input opening of the second shredder to feed the material to the second shredder.

20. A material handling system comprising first and second processing devices, first material transporting means for normally moving material thereon from a first source to said first device, second material transporting means for normally moving material thereon from a second source to said second device, detection means for detecting when one of said devices is inoperative, and operative means operable in response to said detection means for automatically moving the first material transporting means to a position where material thereon from said first source together with material on the second transporting means from said second source is moved to the second device when said first device is inoperative and for automatically moving the second material transporting means to a position where material thereon from said second source together with material on the first material transporting means from said first source is moved to the first device when said second device is inoperative.

21. A material handling and processing system comprising first and second shredders, a first conveyor normally positioned to move material thereon to said first shredder, a second conveyor normally positioned to move material thereon to said second shredder, first and second detection means connected respectively to said first and second shredders for detecting inoperability thereof, first and second movable support means connected respectively to said first and second conveyors, said movable support means being operable in response to detection of inoperability of one of the shredders for moving the first conveyor to a position where material thereon will be moved to the second shredder when inoperability of said first shredder is detected and for moving the second conveyor to a position where material thereon will be moved to the first shredder when inoperability of said second shredder is detected.

22. A material handling and processing system comprising first and second shredders, a first conveyor normally positioned to move material thereon from a first source to said first shredder, a second conveyor normally positioned to move material thereon from a second source to said second shredder, first and second detection means connected respectively to said first and second shredders for detecting inoperability thereof, first and second movable support means connected respectively to said first and second conveyors, said movable support means being operable in response to detection of inoperability of one of the shredders for moving the first conveyor to a position where material thereon from said first source together with material on the second conveyor from said second source will be moved to the second shredder when inoperability of said first shredder is detected and for moving the second conveyor to a position where material thereon from said second source together with material on the first conveyor from said first source will be moved to the first shredder when inoperability of said second shredder is detected.

* * * * *